US007264022B2

(12) United States Patent
Mettler

(10) Patent No.: US 7,264,022 B2
(45) Date of Patent: Sep. 4, 2007

(54) SHAFT ROD FOR HEALD SHAFTS

(75) Inventor: Franz Mettler, Wollerau (CH)

(73) Assignee: Groz-Beckert AG, Albstadt (DE)

( * ) Notice: Subject to any disclaimer, the term of this patent is extended or adjusted under 35 U.S.C. 154(b) by 0 days.

(21) Appl. No.: 11/280,387

(22) Filed: Nov. 17, 2005

(65) Prior Publication Data

US 2006/0102243 A1 May 18, 2006

(30) Foreign Application Priority Data

Nov. 17, 2004 (DE) ..... 10 2004 055 381

(51) Int. Cl.
*D03C 9/06* (2006.01)
*D03C 9/00* (2006.01)

(52) U.S. Cl. ..... 139/92; 139/91; 139/93

(58) Field of Classification Search ..... 139/91, 139/92, 93, 87, 369
See application file for complete search history.

(56) References Cited

U.S. PATENT DOCUMENTS

| | | | | |
|---|---|---|---|---|
| 3,088,496 | A | 5/1963 | Houghton et al. | |
| 3,754,577 | A * | 8/1973 | Heller | 139/92 |
| 3,948,296 | A * | 4/1976 | Koch | 139/91 |
| 4,015,638 | A * | 4/1977 | Graf | 139/91 |
| 4,022,252 | A * | 5/1977 | Ogura | 139/91 |
| 4,144,910 | A * | 3/1979 | Bader | 139/91 |
| 4,508,145 | A * | 4/1985 | Bowen et al. | 139/92 |
| 4,633,916 | A * | 1/1987 | Rast | 139/92 |
| 4,901,767 | A | 2/1990 | Koch | |
| 5,183,082 | A * | 2/1993 | Baumann | 139/92 |
| 5,226,457 | A * | 7/1993 | Gysin et al. | 139/92 |
| 5,230,370 | A * | 7/1993 | Gysin | 139/92 |
| 5,232,025 | A * | 8/1993 | Gysin et al. | 139/92 |
| 5,345,974 | A | 9/1994 | Bernardi et al. | |
| 5,398,989 | A | 3/1995 | Winter et al. | |
| 6,076,250 | A | 6/2000 | Spitzer | |
| 6,732,767 | B2 * | 5/2004 | Baumann | 139/92 |
| 7,114,528 | B2 * | 10/2006 | Schmid et al. | 139/92 |
| 2003/0062093 | A1 * | 4/2003 | Baumann | 139/87 |
| 2004/0244862 | A1 * | 12/2004 | Gesing | 139/93 |
| 2005/0016612 | A1 * | 1/2005 | Manthey et al. | 139/93 |
| 2005/0081941 | A1 * | 4/2005 | Schmid et al. | 139/91 |
| 2005/0081942 | A1 * | 4/2005 | Schwane et al. | 139/92 |

FOREIGN PATENT DOCUMENTS

| | | |
|---|---|---|
| AT | 258224 | 11/1967 |
| DE | 37 02 524 A1 | 8/1988 |
| DE | 296 04 326 U1 | 7/1996 |
| EP | 1 484 438 A2 | 12/2004 |
| EP | 1 156 198 A2 | 4/2005 |

* cited by examiner

*Primary Examiner*—Gary L. Welch
*Assistant Examiner*—Robert H Muromoto, Jr.
(74) *Attorney, Agent, or Firm*—Norman N. Kunitz; Fitch Even Tabin & Flannery

(57) ABSTRACT

A shaft rod (2) having, particularly in its mid region, a particularly low mass. The shaft rod has an upper ledge (11) and a lower ledge (12) which have a reduced thickness in the mid region of the shaft rod. As a result, the load induced by acceleration forces is significantly less in the mid region than in conventional constructions. By virtue of the reduced acceleration forces, the extent of bending of the shaft rods in the middle is less and therefore a shaft rod of such a structure is better adapted for use in very rapidly operating weaving machines.

22 Claims, 4 Drawing Sheets

SHAFT ROD FOR HEALD SHAFTS

CROSS REFERENCE TO RELATED APPLICATION

This application claims the priority of German Patent Application No. 10 2004 055 381.5, filed on Nov. 17, 2004, the subject matter of which, in its entirety, is incorporated herein by reference.

FIELD OF THE INVENTION

The invention relates to a shaft rod for a heald shaft and also concerns a weaving machine provided with such a heald shaft.

BACKGROUND OF THE INVENTION

For shed-forming, in weaving machines heald shafts are used which carry healds and with which the warp threads are, by means of the healds, moved out of the middle plane of the warp threads. The heald shafts, with an upper shaft rod positioned above and a lower shaft rod positioned under the warp threads, extend over the entire width of the woven fabric to be manufactured. The ends of the shaft rods are interconnected by side binders. The shaft rods support respective shaft staves which, in turn, carry the healds. Shed-forming occurs by rapid upward and downward motion of the heald shaft. Since such upward and downward motion is derived from the rpm of the main drive shaft of the weaving machine, considerations about an increase of the speed of the reciprocating motion of the heald shaft also involve an increase of the machine rpm. It is a desideratum to increase the rpm of the weaving machine which, particularly in case of large fabric widths, leads to large loads on the heald shafts. The shaft rods are critical as concerns the productivity of the heald shaft. The bending resistance of the shaft rods during dynamically changing loads is of prime importance. The more rigid the shaft rods, the more rpm-resistant the entire heald shaft.

The majority of the manufactured and sold heald shafts is under a significant price pressure. For this reason, aluminum has been found very advantageous as the material for the shaft rods. On the one hand, aluminum components with complex cross sections may be made with extrusion presses and, on the other hand, a heald shaft made in this manner is, based on the low specific weight of aluminum, of remarkably low mass, yet relatively inexpensive. In cases where the load limit of aluminum is exceeded, other materials have also been successfully used.

For example, German Patent Document DE 37 02 524 describes a shaft rod which is a welded sheet metal construction. It constitutes a rectangular hollow profile member having an upper ledge and a lower ledge as well as two thin sheet metal components which form the side walls and connect the upper and the lower ledges with one another. The resistance of such a shaft rod to alternating bending forces is, based on the material used, considered to be greater than that of an aluminum shaft rod.

U.S. Pat. No. 5,345,974 discloses a shaft rod which is made of a fiber composite material and which has a stiffness similar to that of a shaft rod made of metal elements, but is of lesser weight.

While according to the starting point in the above-named patent documents the shaft rod has a substantially constant cross section along its entire length, German Patent Document DE 199 17 791 C1 shows a shaft rod having a varying profile along its length. The shaft rod is a hollow profile member which has its greatest height approximately in its middle. The profile height tapers towards the ends. Such a configuration is obtained by providing a hollow metal member whose height is reduced at both ends by milling. The exposed openings, resulting from the cuts through chambers in the metal profile member, are closed off by a strip.

Such a profile member can be considered as being optimized as concerns static loads. It has been found, however, that under dynamic loads, despite the greater stiffness of the profile member in the middle, a significant bending of the shaft rod occurs.

It is therefore the object of the invention to provide a shaft rod which exhibits but a slight bending tendency under dynamic loads.

SUMMARY OF THE INVENTION

This object is achieved with a shaft rod for a heald shaft, comprising: a shaft stave arranged for receiving end eyelets of healds; and a carrier body comprising two narrow sides formed by an upper ledge, a lower ledge, and at least one wide side formed by a side wall, with at least one of the ledges having a changing thickness along its length direction.

The shaft rod according to the invention has, for example, a box-profile cross section, an I-cross section or a C-cross section. The cross-sectional profile has a reduced mass in a mid region. This may be obtained, for example, by providing that the upper and/or lower ledge is made thinner toward its middle, that is, it has a greater thickness at its ends than in the vicinity of its middle. In this manner the mass of the shaft rod is concentrated to its ends. The mass of the mid region is reduced, so that inertia forces which are to be overcome upon acceleration or braking of the shaft rod are decreased. At the same time, the stiffness is essentially preserved, whereby the extent of dynamic bending of the shaft rod is reduced. This permits higher machine rpm's and/or greater fabric widths. Such a measure applies primarily to heald shafts without central supports. In case central supports are present, it may be expedient to provide the regions of smallest wall thickness approximately centrally between different central supports or centrally between a central support and a lateral support.

The reduction of the cross-sectional surface of the upper ledge and/or the lower ledge extending from the ends of the shaft rod toward its middle is primarily a reduction of thickness of the respective ledge, measured perpendicularly to the shaft rod. The thickness variation may be gradual or stepped. The ledges may each be a single-piece or a multi-part component. The outer height of the shaft rod preferably remains constant. For example, the upper and lower ledges each have a narrow upper and, respectively, lower, strip-shaped outer side which extend parallel to one another. The upper and lower ledges are interconnected by at least one, or two side walls, so that either an open profile or a closed profile (box profile) is obtained. The at least one side wall is preferably relatively thin. For an additional stiffening, between the upper ledge and the lower ledge, additionally to the side walls, connecting elements may be provided which extend from one ledge to the other. The connecting elements are preferably relatively low-mass, rigid elements which are particularly pressure-resistant and which provide for a sufficient form stability. It is furthermore feasible to arrange a supporting body between the upper ledge and the lower ledge which is connected particularly with the at least one side wall. The supporting body may be a low-mass foam body, a honeycomb body or the like. It permits the provision of particularly thin side walls which are still sufficiently rigid and do not show any tendency for bulging even under dynamic loads.

The side walls have such a thickness at least in portions, as to permit the attachment thereto of securing elements at a desired location. This is required, for example, when the shaft rod in the weaving machine is loaded by a pulling forces derived from the warp threads and being oriented transversely to the shaft rod.

The parts of the shaft rod may be metal, such as aluminum, special steel or a fiber composite material. A preferred embodiment of the shaft rod includes two thin, light side walls of a fiber composite material, aluminum sheet or very thin steel sheet. They form a rectangular, hollow body together with the ledges of varying cross section. For securing the side walls against bulging under load, the side walls are, at least along one part of their length, connected with a supporting body which is, for example, an aluminum honeycomb structure or a phenol resin-reinforced fiber paper. A hard-foam core may also find application. The supporting body fills the entire hollow chamber—inasmuch as the space is not needed, for example, to accommodate the corner connection at the ends of the shaft rod for securing the lateral supports. It may also be necessary to leave a free space for the attachment of driving parts. The supporting body may, together with the side walls, assume the function of the earlier-noted connecting element.

In many instances it is sufficient if only that ledge of the shaft rod has a longitudinally varying cross section which is situated remote from the shaft stave. In turn, the ledge adjoining the shaft stave may have a uniform cross section. Such a shaft rod also obtains the required stiffness by virtue of the stiffness of the shaft stave. In this instance too, the mass of the mid region of the shaft rod is reduced as compared to correspondingly large shaft rod portions which join the shaft rod ends.

The mass reduction of the shaft rod particularly in the mid region, while maintaining the outer contour over the entire shaft rod length, makes possible to obtain shaft rods whose dynamic load bearing capacity is increased compared to known shaft rods.

Other details of advantageous embodiments of the invention are disclosed in the claims, the drawing or the description.

DETAILED DESCRIPTION OF THE INVENTION

Figure 1:
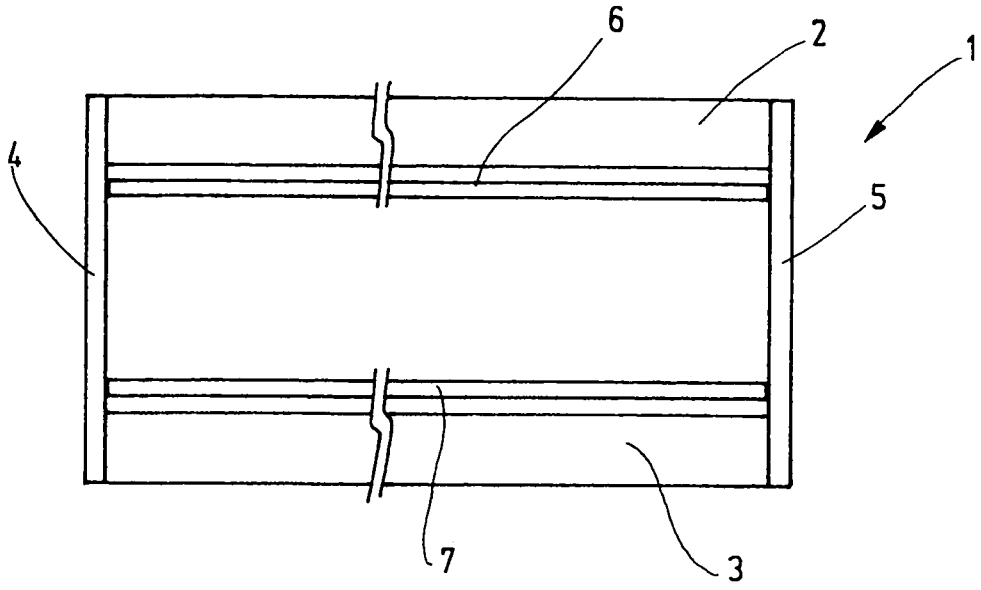
FIG. 1 is a schematic front elevation of a heald shaft.

FIG. 1 illustrates a heald shaft 1 comprising an upper shaft rod 2, a lower shaft rod 3, as well as two side binders 4, 5. The shaft rods 2, 3 hold shaft staves 6, 7 which, as shown, for example, in FIG. 2, are flat steel profile members.

Figure 2:
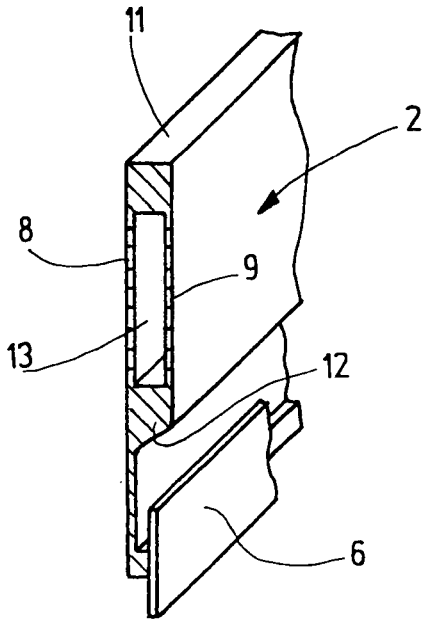
FIG. 2 is a fragmentary perspective view of a heald shaft of conventional construction.

Conventionally, the shaft rod 2, as shown in FIG. 2, is an extruded aluminum profile member having a hollow box profile. It has two side walls 8, 9 forming flat sides. At the top and bottom respective ledges 11, 12 are provided which form one-piece components with the side walls 8, 9 and enclose an inner space 13. The cross section of the shaft rod 2 is unchanged along its length.

Figure 3:
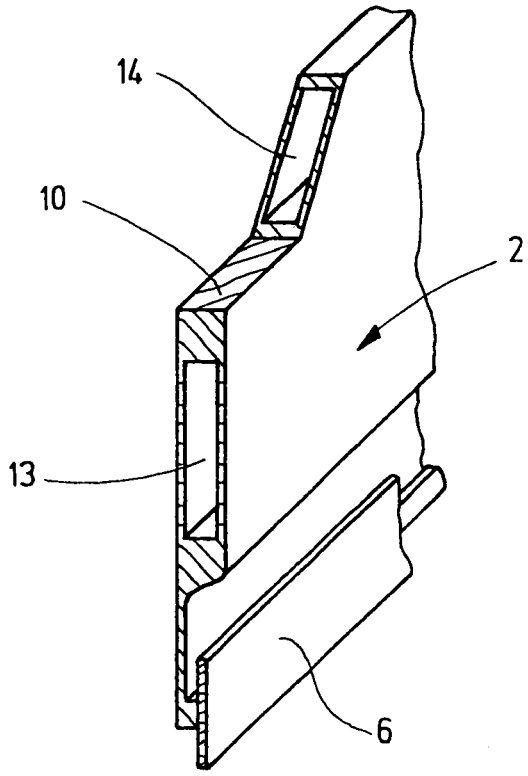
FIG. 3 is a fragmentary perspective view of a modified embodiment of a conventional shaft rod.

FIG. 3 shows a modified variant of he above-described conventional shaft rod. The FIG. 3 embodiment is a two-chamber profile member having an intermediate ledge 10. The embodiment has two inner chambers 13, 14. One part of the shaft rod, particularly in the upper edge region, may be milled off for facilitating the joining of the side binders 4, 5.

Figure 4:
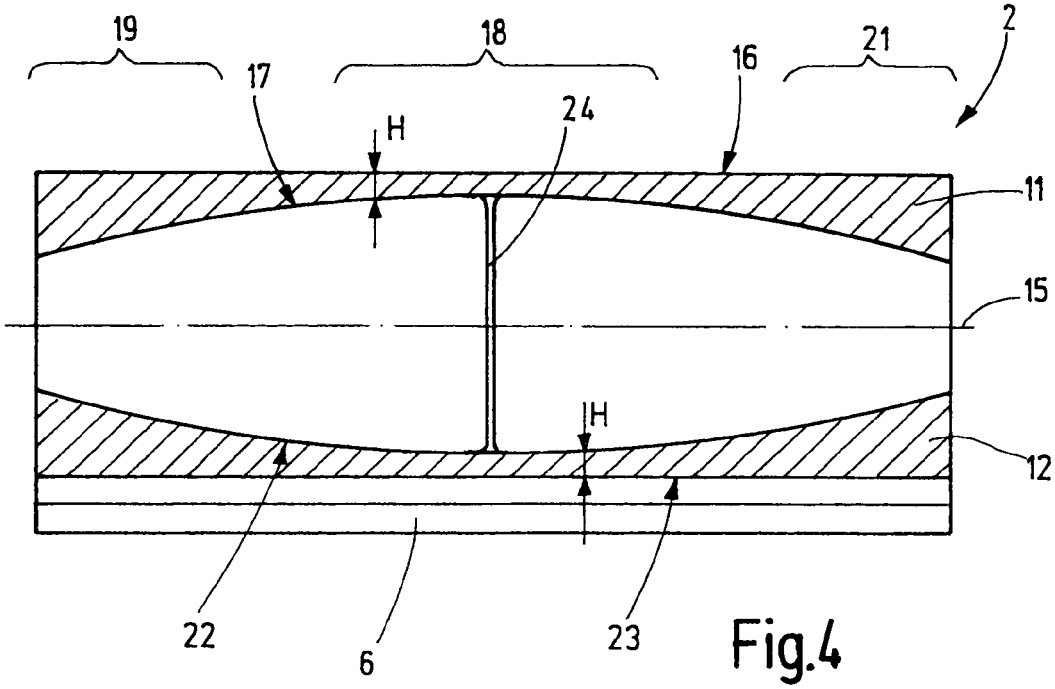
FIG. 4 is a fragmentary longitudinal sectional view of a shaft rod according to the invention.

The shaft rod according to the invention differs from the known shaft rods of FIGS. 2 and 3 by the shape of the flanges 11, 12 and the possibly present intermediate ledge 10. As shown in FIG. 4, the ledges 11, 12 have a height, that is, a vertically measured thickness H which varies along the length direction 15. The upper ledge 11 has a preferably planar outer side 16 which extends linearly in the longitudinal direction 15. The ledge 11 has an oppositely located, for example, arcuately formed, inner side 17. The thickness H is measured between the inner side 17 and the outer side 16. The arch of the inner side 17 is so designed that the thickness H is significantly less in a mid region 18 of the ledge 11 than in the end regions 19, 21 of the shaft rod.

The lower ledge 12 may similarly have a thickness H which varies in the longitudinal direction 15. Thus, here too, its inner side 22 is not parallel to its outer side 23 facing the shaft stave 6. In the shaft rod end regions 19, 21 the ledges 11, 12 are thus thicker than in the mid region 18.

Between the ledges 11, 12 a supporting element 24 may be provided which is preferably centrally arranged between the shaft rod end regions 19, 21. The supporting element 24 may be, for example, a carbon fiber-reinforced composite web, an aluminum web, a steel support or the like. It may be formed as a one-piece component with the ledges 11,12, or may be glued or welded thereto.

Figures 5, 6:
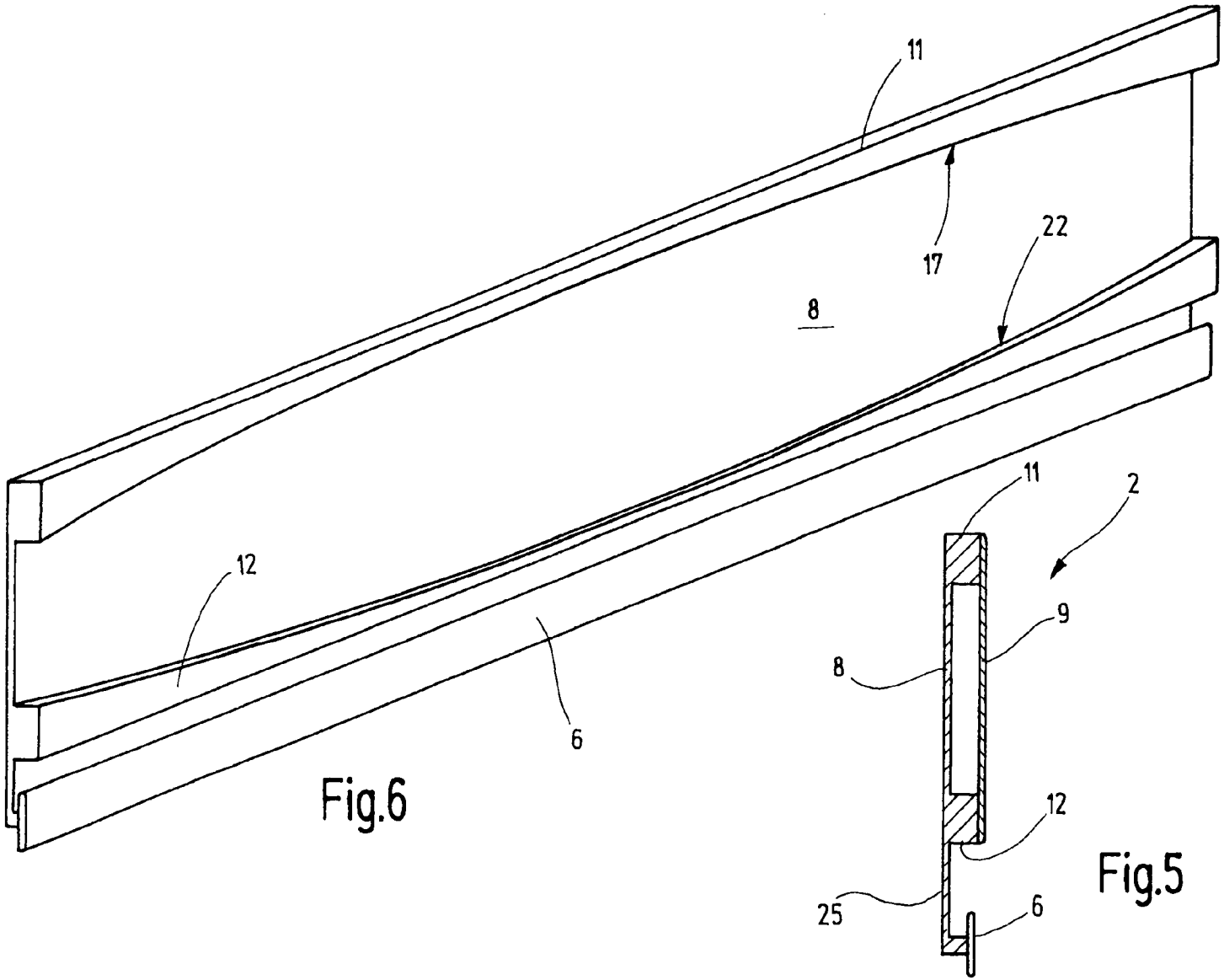
FIG. 5 is a cross-sectional view of the shaft rod of FIG. 4.
FIG. 6 is a perspective view of an element of the shaft rod of FIG. 5.

The shaft rod 2 according to FIG. 4 is shown in cross section in FIG. 5. It has, for example, an aluminum base body which includes the side wall 8, the ledges 11,12 and an extension 25 of the wall 8, projecting downward beyond the lower ledge 12 to form a holder for the shaft stave 6. FIG. 6 shows, in a perspective illustration, the base body as the shaft rod 2, together with the shaft stave 6. The base body may be, for example, a cut portion of an extruded aluminum profile member which is first severed from an endless profile member. In a subsequent step, the desired profile of the ledges 11, 12 may be provided, for example, by milling the inner sides 17, 22. Thereafter, as shown in FIG. 5, the side wall 9 may be attached, which is, for example, a thin metal sheet. It may be secured to the ledges 11, 12 by gluing or welding.

The shaft rod obtained in the above-described manner has, in its middle region 18 (FIG. 4) a lesser weight per unit length than in its end regions 19, 21. Therefore the mid region is exposed to reduced dynamic loads during operation. It has been found that the shaft rod 2 permits higher machine rpm's and may extend over greater fabric widths than conventional shaft rods. It has further been found that the stiffness reduction caused by the weight reduction in the mid region 18 is largely exceeded by the reduction of the dynamic loads. A thinning of the ledges 11, 12 along their entire length to the thickness at the mid region 18 is, however, not to be effected particularly as concerns the upper shaft rod 11, due to the inherent weakening of the shaft rod 2 which would manifest itself in an increased tendency to deformation.

The ledge 12 is an exception; if required, it may have along its entire length a small height or thickness H as present in any event, for example, in the mid region 18. The stiffening of the shaft rod 2 is, in such a case, taken over by the shaft stave 6. This applies particularly to embodiments in which the shaft stave 6 is connected with the extension 25 firmly and non-shiftably, particularly in the longitudinal direction. Tension and pressure stresses derived from the bending loads and applied to the shaft rod are then taken up by the shaft stave.

The profile member shown in FIG. 6 may also find use as an open profile, without the side wall 9. The side wall 8, as shown in FIG. 5, may be oriented in alignment with the extension 25 or approximately centrally with respect to the ledges 11, 12. In such a case a modified I-profile is obtained.

Figure 7:
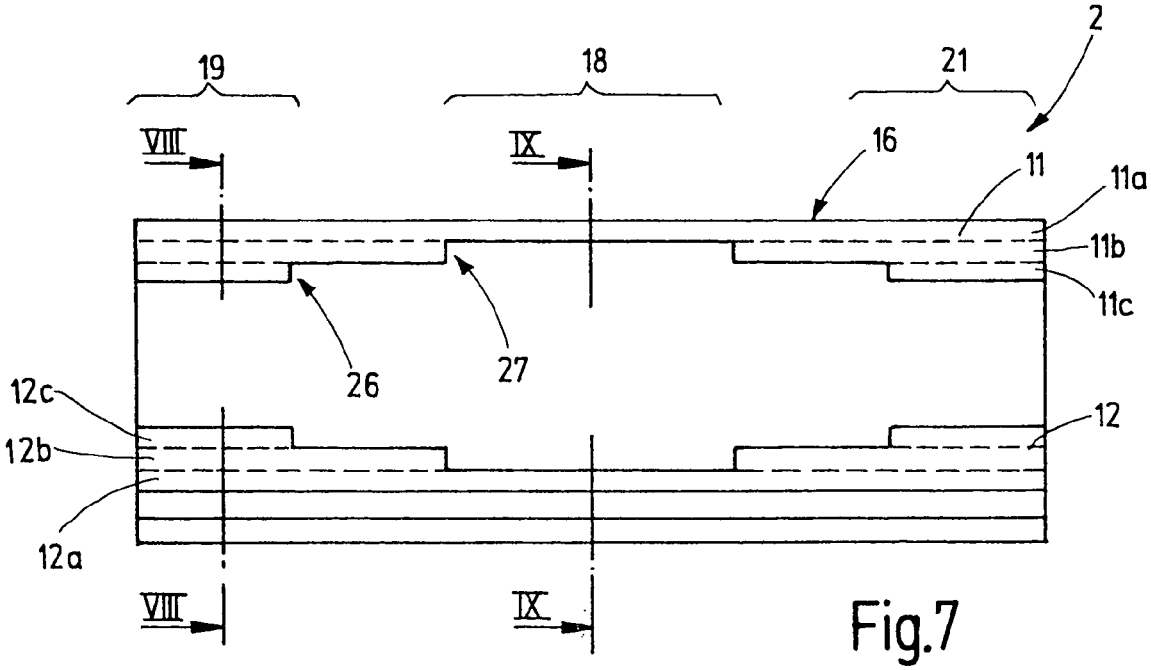
FIG. 7 is a schematic view of a modified embodiment of a shaft rod, having a stepped inner profile.
Figure 8:
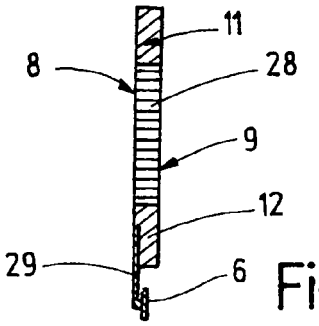
FIG. 8 is a sectional view of the shaft rod of FIG. 7, taken along line VIII-VIII.
Figure 9:
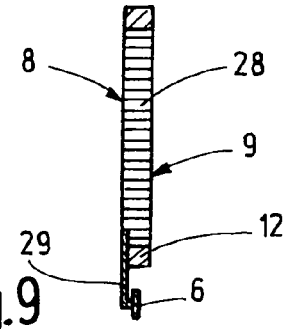
FIG. 9 is a sectional view of the shaft rod of FIG. 7, taken along line IX-IX.

According to the embodiment shown in FIGS. 4 to 6, the ledges 11, 12 are similar to elongated wedges. The thickness H of the ledges 11, 12 gradually decreases from the ends toward the middle. As shown in FIGS. 7, 8 and 9, however, the thickness reduction may be stepped. In such a construction the ledges 11, 12 are, for example, made of a fiber composite material. The ledges 11, 12 may consist, for example, of individual bars 11*a*, 11*b*, 11*c* and, respectively, 12*a*, 12*b*, 12*c* and made of a carbon fiber-reinforced material. The bars may have unequal lengths and may be glued to one another. For example, the outer bars 11*a*, 12*a* may be throughgoing, while the shorter bars 11*b*, 11*c*, 12*b*, 12*c* are flush with the ends of the shaft rod 2. In this manner steps 26, 27 are obtained, whereby the thickness of the respective ledge decreases toward the mid region 18 from the end regions 19, 21 of the shaft rod. The steps may be straight or oblique to form ramps.

As shown in FIGS. 8 and 9, the ledges 11,12 stepped in the above-described manner may be connected with sheet metal members or thin, plate-like elements made of a fiber composite material which constitute the side walls 8, 9. For stiffening, between the side walls 8, 9 a supporting body 28 may be provided which may be, for example, a honeycomb body. Such honeycomb structures may be made of aluminum sheet, resin-impregnated paper or another suitable, light construction material. The honeycomb bodies are preferably glued to at least one side wall 8, but preferably to both side walls 8 and 9.

Further, to the lower ledge 12 one or more holders 29 are glued for carrying the shaft stave 6. Preferably, the holders 29 are glued to the side walls 8, 9.

The light-structure shaft rod built in such a manner has a reduced weight in its mid region 18. The adjoining end regions 19, 21 of the shaft rod, however, have, based on the thicker regions of the ledges 11, 12, a particularly great stiffness, whereby bending of the shaft rod is minimized under dynamic loads.

Figure 10:
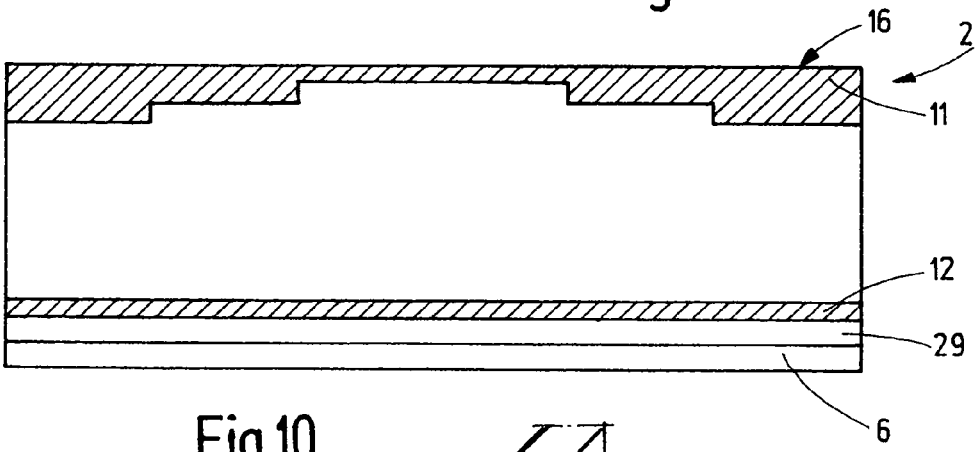
FIG. 10 is a longitudinal sectional view of a modified embodiment of the shaft rod, having an inner profile, where solely the ledge remote from the shaft stave has a stepped structure.
Figure 11:
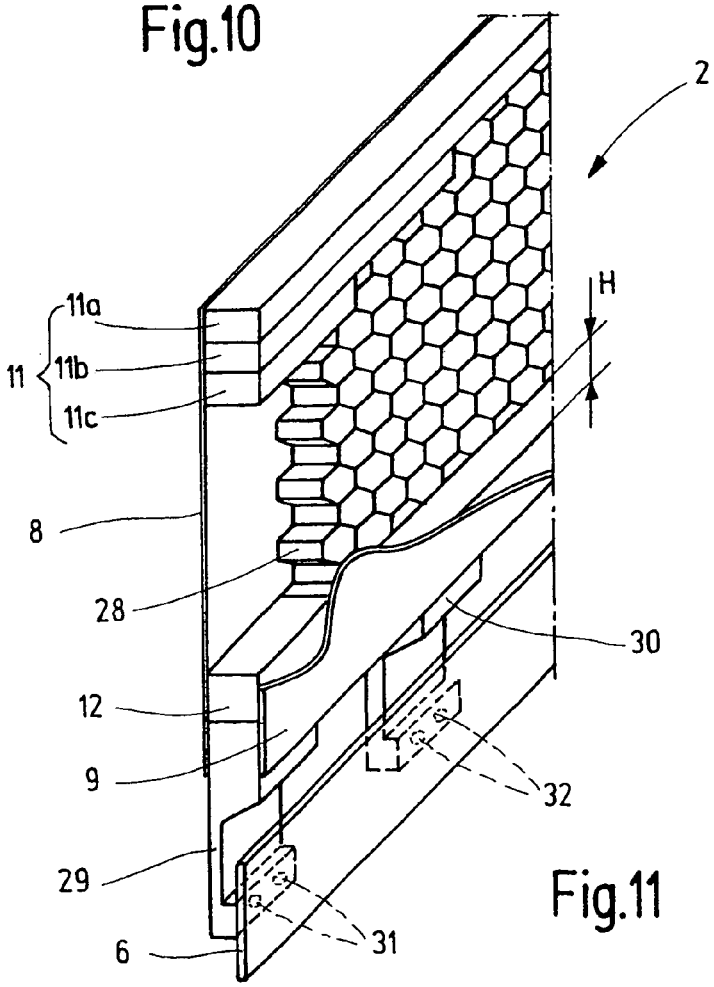
FIG. 11 is a perspective, fragmentary, partially sectional view of the shaft rod of FIG. 10.

FIGS. 10 and 11 illustrate a shaft rod 2 which corresponds essentially to the shaft rod 2 according to FIGS. 7 to 9. Therefore, reference is made to the preceding description in conjunction with the same reference characters. As a departure from the previously described shaft rod 2, the lower ledge 12 has a constant thickness H. The upper ledge 11 situated remote from the shaft stave 6, however, is stepped as described earlier. The upper ledge 11 is formed of elongated, rectangular parts 11*a*, 11*b*, 11*c* which are glued to one another and are made, for example, of a fiber composite material. The side walls 8, 9 are glued to the supporting body 28 and the ledges 11, 12. The side walls 8, 9 project downward beyond the lower ledge 12 and accommodate individual holders 29, 30 between themselves. The latter may be of metal or plastic, preferably fiber-reinforced plastic. They have a slender neck adjoined by a holding portion against which the shaft stave 6 lies. The shaft stave 6 is in this arrangement connected with the holders 29, 30, for example, by screws 31, 32. If required, rivets or other connecting means may be utilized.

This shaft rod 2 likewise excels by its high dynamic bending resistance. The weight reduction present in its mid region, coupled with the more rigid design of the outer regions of the shaft rod makes possible to achieve the highest operational speeds, that is, the highest operational machine rpm's.

A shaft rod 2 according to the invention has, particularly in its mid region, a particularly low mass. The shaft rod has an upper ledge 11 and a lower ledge 12 which have a reduced thickness in the mid region of the shaft rod. As a result, the load induced by acceleration forces is significantly less in the mid region than in conventional constructions. By virtue of the reduced acceleration forces, the extent of bending of the shaft rods in the middle is less and therefore a shaft rod of such a structure is better adapted for use in very rapidly operating weaving machines.

It will be appreciated that the above description of the present invention is susceptible to various modifications, changes and adaptations, and the same are intended to be comprehended within the meaning and range of equivalents of the appended claims.

LIST OF REFERENCE CHARACTERS

1 heald shaft
2, 3 shaft rods
4, 5 side binders
6, 7 shaft staves
8, 9 side walls
10 intermediate ledge
11, 12 ledges
11*a*, 11*b*, 11*c* bars
12*a*, 12*b*, 12*c* bars
13, 14 inner chambers
15 longitudinal direction
16 outer side
17 inner side
18 mid region
19, 21 end regions of the shaft rod
22 inner side
23 outer side
24 supporting element
25 extension
26, 27 steps
28 supporting body
29, 30 holders
31, 32 screws
H thickness

What is claimed is:

1. A shaft rod for a heald shaft (1), comprising:

a shaft stave arranged for receiving end eyelets of healds; and, a carrier body comprising two narrow sides formed by an upper ledge and a lower ledge, and at least one wide side formed by a side wall, with at least one of the ledges having a changing thickness (H) along its length direction; and wherein the at least one ledge having a changing thickness, extends from an end region of the shaft rod to another end region of the shaft rod and has, in the end regions of the shaft rod, a thickness (H) which is greater than in a region situated therebetween.

2. The shaft rod as defined in claim 1, wherein the ledge adjoining the shaft stave has a constant cross section.

3. The shaft rod as defined in claim 1, wherein both ledges have, in the end regions, a thickness (H) which is greater than in a region situated therebetween.

4. The shaft rod as defined in claim 1, wherein the at least one ledge has steps at which the thickness of the ledge changes.

5. The shaft rod as defined in claim 1, wherein the at least one ledge has wedge-shaped portions.

6. The shaft rod as defined in claim 1, wherein the at least one ledge is arcuately bent at its inner side.

7. The shaft rod as defined in claim 1, wherein both ledges have a straight outer side in the longitudinal direction.

8. The shaft rod as defined in claim 1, wherein the at least one side wall and the ledges are made of the same material.

9. The shaft rod as defined in claim 1, wherein the at least one side wall and the ledges are connected to one another as a one-piece component.

10. The shaft rod as defined in claim 1, wherein the at least one side wall is of a fiber composite material.

11. The shaft rod as defined in claim 1, wherein the at least one side wall is a metal.

12. The shaft rod as defined in claim 1, wherein the upper and lower ledges are of a fiber composite material.

13. The shaft rod as defined in claim 1, wherein the upper and lower ledges are made of metal.

14. The shaft rod as defined in claim 1, wherein a second side wall is provided which forms a box profile with the other side wall, the upper ledge and the lower ledge.

15. The shaft rod as defined in claim 1, wherein a supporting body is provided between the upper ledge and the lower ledge.

16. The shaft rod as defined in claim 15, wherein the supporting body is a honeycomb body.

17. The shaft rod as defined in claim 15, wherein the supporting body is a foam body.

18. The shaft rod as defined in claim 15, wherein the at least one side wall is metal; the upper and lower ledges are made of metal; and, parts made of metal are connected to one another by welds and the remaining parts are connected to one another by glue.

19. The shaft rod as defined in claim 1, wherein a connecting element is arranged between the upper ledge and the lower ledge.

20. The shaft rod as defined in claim 19, wherein the connecting element is arranged in a portion spaced from the end regions of the shaft rod.

21. A weaving machine having at least one heald shaft provided with at least one shaft rod as defined in claim 1.

22. The shaft rod as defined in claim 1, wherein the two ledges each have a flat outer surface, with the two outer surfaces being parallel to one another.

* * * * *